US009902191B2

(12) United States Patent
Prigent et al.

(10) Patent No.: US 9,902,191 B2
(45) Date of Patent: Feb. 27, 2018

(54) FOUNTAIN PEN

(71) Applicant: Louis Vuitton Malletier, Paris (FR)

(72) Inventors: Vincent Prigent, Paris (FR); Jean Roptin, Nantes (FR); Christophe Turco, Les Terraillers (FR); Luca Aquafresca, Minerbio Bo (IT); Gianluca Malaguti, Parc Saint Roman (MC)

(73) Assignee: LOUIS VUITTON MALLETIER, Paris (FR)

( * ) Notice: Subject to any disclaimer, the term of this patent is extended or adjusted under 35 U.S.C. 154(b) by 103 days.

(21) Appl. No.: 14/443,022

(22) PCT Filed: Nov. 14, 2013

(86) PCT No.: PCT/FR2013/052740

§ 371 (c)(1),
(2) Date: May 14, 2015

(87) PCT Pub. No.: WO2014/076426

PCT Pub. Date: May 22, 2014

(65) Prior Publication Data

US 2015/0298487 A1 Oct. 22, 2015

(30) Foreign Application Priority Data

Nov. 16, 2012 (EP) ..... 12306432

(51) Int. Cl.
*B43K 5/18* (2006.01)
*B43K 5/04* (2006.01)
(Continued)

(52) U.S. Cl.
CPC ..... *B43K 5/1827* (2013.01); *B43K 5/02* (2013.01); *B43K 5/04* (2013.01); *B43K 5/14* (2013.01); *B43K 5/1809* (2013.01)

(58) Field of Classification Search
CPC ... B43K 5/04; B43K 5/08; B43K 5/14; B43K 5/145; B43K 5/1818; B43K 5/1827; F16K 7/04
See application file for complete search history.

(56) References Cited

U.S. PATENT DOCUMENTS 2,045,774 A * 6/1936 Hirschy ..... B43K 5/145 222/518
2,126,540 A * 8/1938 Dicks ..... B43K 5/14 401/237
(Continued)

FOREIGN PATENT DOCUMENTS

FR 1 297 893 A 7/1962
JP S 5098834 U 8/1975
(Continued)

OTHER PUBLICATIONS

International Search Report Application No. PCT/FR2013/052740 report dated May 22, 2014.
(Continued)

*Primary Examiner* — Jennifer C Chiang
*Assistant Examiner* — Bradley Oliver
(74) *Attorney, Agent, or Firm* — Miller, Matthias & Hull LLP

(57) ABSTRACT

A fountain pen comprising: an elongate hollow body defining an inner chamber designed to receive an ink container; a nib disposed at a first end of the hollow body; and a connection part connecting the inner chamber to the nib and defining an ink flow passage extending along a longitudinal axis (XX), the connection part comprising a valve opening and closing the ink flow passage, designed to selectively open and close the ink flow passage. The connection part comprises a striker interposed between the valve and the
(Continued)

inner chamber and designed to engage with the ink container and allow a flow of ink between the ink reservoir and the nib.

16 Claims, 6 Drawing Sheets

(51) Int. Cl.
*B43K 5/14* (2006.01)
*B43K 5/02* (2006.01)

(56) References Cited

U.S. PATENT DOCUMENTS

| | | | | | |
|---|---|---|---|---|---|
| 2,542,267 | A * | 2/1951 | Terrell | ..... | B43K 5/04 401/169 |
| 4,386,866 | A * | 6/1983 | Graham | ..... | B43K 5/14 401/133 |
| 2012/0294668 | A1* | 11/2012 | Malaguti | ..... | B43K 5/04 401/234 |
| 2016/0229218 | A1* | 8/2016 | Hoshino | ..... | B43K 8/03 |

FOREIGN PATENT DOCUMENTS

| | | | |
|---|---|---|---|
| JP | S 5716383 | U | 1/1982 |
| JP | 2008224540 | A | 8/2006 |
| WO | WO 2009/141747 | A1 | 11/2009 |
| WO | WO 2011/092624 | A1 | 8/2011 |

OTHER PUBLICATIONS

Japanese Office Action related to Application No. S49-007774, dated Nov. 13. 2017.

* cited by examiner

FOUNTAIN PEN

CROSS-REFERENCE TO RELATED APPLICATION

This Application is a 35 USC §371 US National Stage filing of International Application No. PCT/FR2013/052740 filed on Nov. 14, 2013, and claims priority under the Paris Convention to European Patent Application No. 12306432.1 filed on Nov. 16, 2012.

FIELD OF THE DISCLOSURE

The present invention relates to a fountain pen comprising:

- an elongate hollow body defining an inner chamber designed to receive an ink reservoir, also referred to herein as an "ink container";
- a nib arranged at a first end of the hollow body; and
- a connection part connecting the inner chamber and the nib and defining an ink flow passage extending along a longitudinal axis, the connection part comprising a valve for opening and closing the ink flow passage, designed to selectively open and close the ink flow passage.

BACKGROUND OF THE DISCLOSURE

Because of their structure, conventional fountain pens often leak ink when subjected to changes in temperature and/or pressure.

A change in temperature occurs when a user is writing, as the user's hand warms the body of the fountain pen.

A change in pressure occurs when traveling by plane, as a result of the constant changes in altitude of the aircraft.

To solve this problem, a fountain pen of the aforementioned type has been developed in which a cap is provided to protect the nib when the fountain pen is not in use, the cap cooperating with the valve by means of lugs that close the ink flow passage when the cap is in place on the pen.

However, it has been observed that when the cap is opened there is always some ink leakage, even if minimal.

It has also been found that in such a fountain pen, the flow of ink through the various elements is not optimal, which can interfere with writing smoothly.

SUMMARY OF THE DISCLOSURE

The present invention aims to overcome these disadvantages by proposing a fountain pen that facilitates the passage of ink when writing, while being leak-tight regardless of the conditions to which it is exposed.

To this end, the invention relates to a fountain pen of the aforementioned type, characterized in that the connection part comprises a striker interposed between the valve and the inner chamber and designed to engage with the ink reservoir and allow ink to flow between the ink reservoir and the nib.

With these arrangements, the flow of ink through the fountain pen is facilitated and the leak prevention is improved.

In preferred embodiments of the invention, one or more of the following arrangements may possibly be used:

- the valve comprises a tubular member defining a portion of the ink flow passage and comprising a central section that is elastically deformable between a rest position where the ink flow passage is open, and a deformed position where the ink flow passage is closed;

- the fountain pen comprises a barrel that supports the nib and a pair of opposing pins mounted on the barrel, the pins being designed to deform the central section;
- the pins are mounted so as to slide relative to the barrel in a direction perpendicular to the longitudinal axis;
- the fountain pen comprises a protective cap for the nib, designed to be mounted onto the barrel along the longitudinal axis and to displace the pins when it is mounted onto the barrel;
- the central section has a substantially square-shaped internal cross-section;
- the pins are offset angularly, about the longitudinal axis, relative to a diagonal of the square internal cross-section of the central section;
- the offset angle is substantially equal to 20°;
- the tubular member comprises an end section arranged between the central section and the striker and defining a portion of the ink flow passage, the end section comprising an inner surface and a plurality of longitudinal grooves created on the inner surface;
- the tubular member comprises a pair of opposing cuts made in the square internal cross-section of the central section where it connects to the end section;
- the striker comprises a substantially cylindrical tongue delimiting a portion of the ink flow passage and having a stepped contour with two steps;
- the tongue comprises an inner surface and a plurality of longitudinal grooves created on the inner surface;
- the fountain pen further comprises a converter forming the ink reservoir and mounted on the striker;
- the fountain pen further comprises a cartridge forming the ink reservoir and mounted on the striker, the cartridge comprising a rigid tube, a mouth arranged at one end of the tube, and a tube sealing plug inserted into the mouth; and
- the mouth has an inside diameter that is greater than the outside diameter of the tongue of the striker.

The invention also relates to a converter forming the ink reservoir for a fountain pen as defined above, characterized in that it comprises a flexible pouch extending along a longitudinal axis and intended to be in fluid communication with the nib by means of the connection part, and a piston mounted so as to slide along the longitudinal axis and intended to deform the flexible pouch.

BRIEF DESCRIPTION OF THE DRAWINGS

The invention will be better understood by reading the following description of one embodiment of the invention, given by way of example only, with reference to the accompanying drawings in which.

In the various figures, the same references designate identical or similar elements.

DETAILED DESCRIPTION OF THE DISCLOSURE

Figure 1:
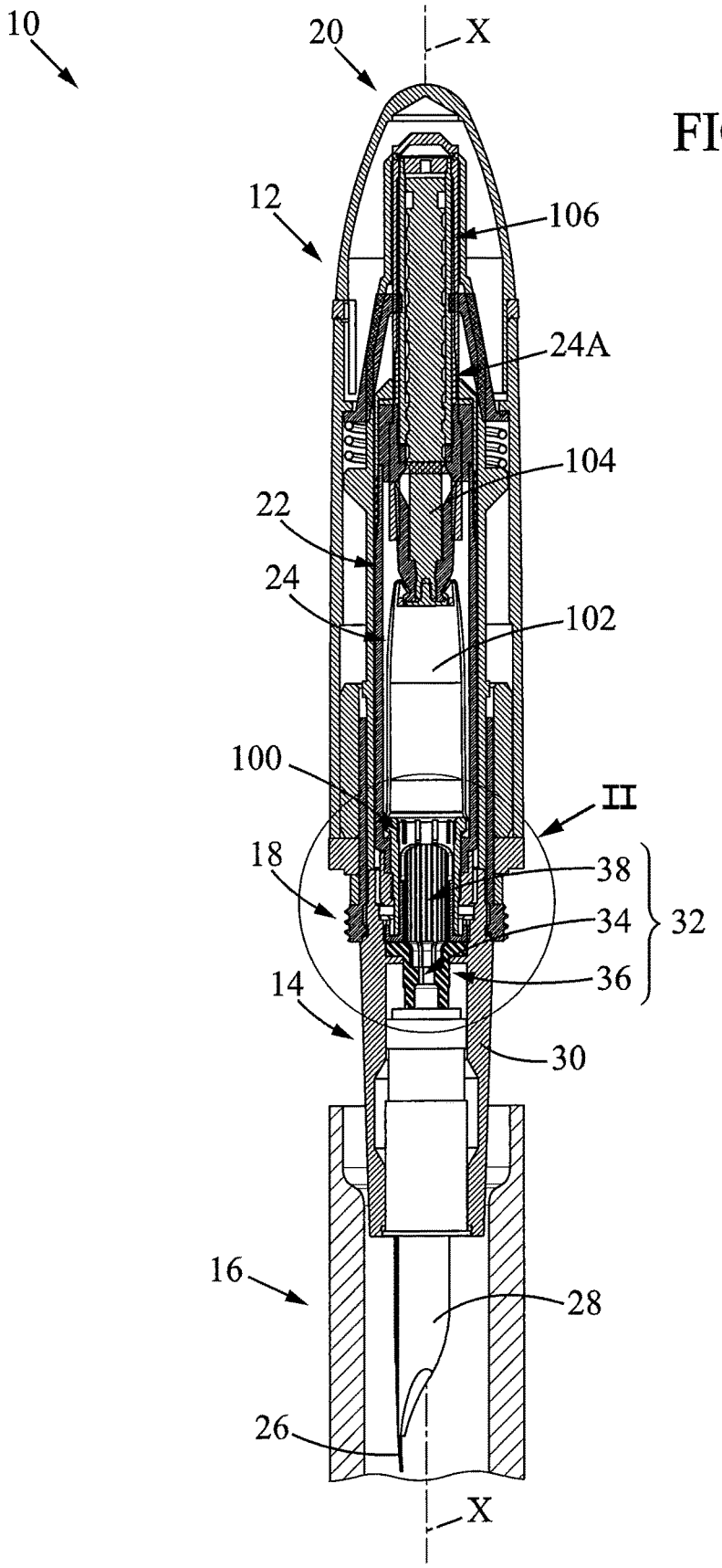
FIG. 1 is a sectional view of a fountain pen according to the invention.

FIG. 1 illustrates a fountain pen 10 according to the invention.

The fountain pen 10 comprises an elongate hollow body 12, a nib unit 14 mounted on the hollow body 12, and a cap 16 intended for mounting on the hollow body 12.

The hollow body 12 is designed to be gripped by the user's hand during normal use of the fountain pen 10, namely when writing.

The hollow body 12 has a substantially cylindrical shape extending along a longitudinal axis XX, and comprises an open first end 18 and a closed second end 20 opposite the open first end 18.

Between the first and second ends 18, 20, the hollow body 12 defines an inner chamber 22 adapted to receive an ink reservoir 24 as will be explained in more detail below.

The nib unit 14 conventionally comprises a nib 26, a tube 28 for supplying ink to the nib 26 (generally called the "feeder" or feed), and a barrel 30 that supports the nib 26 and the feeder 28.

The nib unit 14 is mounted on the first end 18 of hollow body 12, in particular by screwing.

The nib unit 14 is of a type well known in the art and therefore will not be detailed below.

The cap 16 for protecting the nib 26 when the fountain pen 10 is not in use, is designed to be mounted onto the barrel 30 along the longitudinal axis XX and temporarily secured to the hollow body 12, in particular by snap-fitting or screwing it into place.

The fountain pen 10 further comprises a connection part 32 connecting the inner chamber 22 and the nib 26/feeder 28 assembly, and defining an ink flow passage 34 extending along the longitudinal axis XX.

The connection part 32 comprises a valve 36 for opening and closing the ink flow passage 34 and a striker 38 interposed between the valve 36 and the inner chamber 22.

Figure 2:
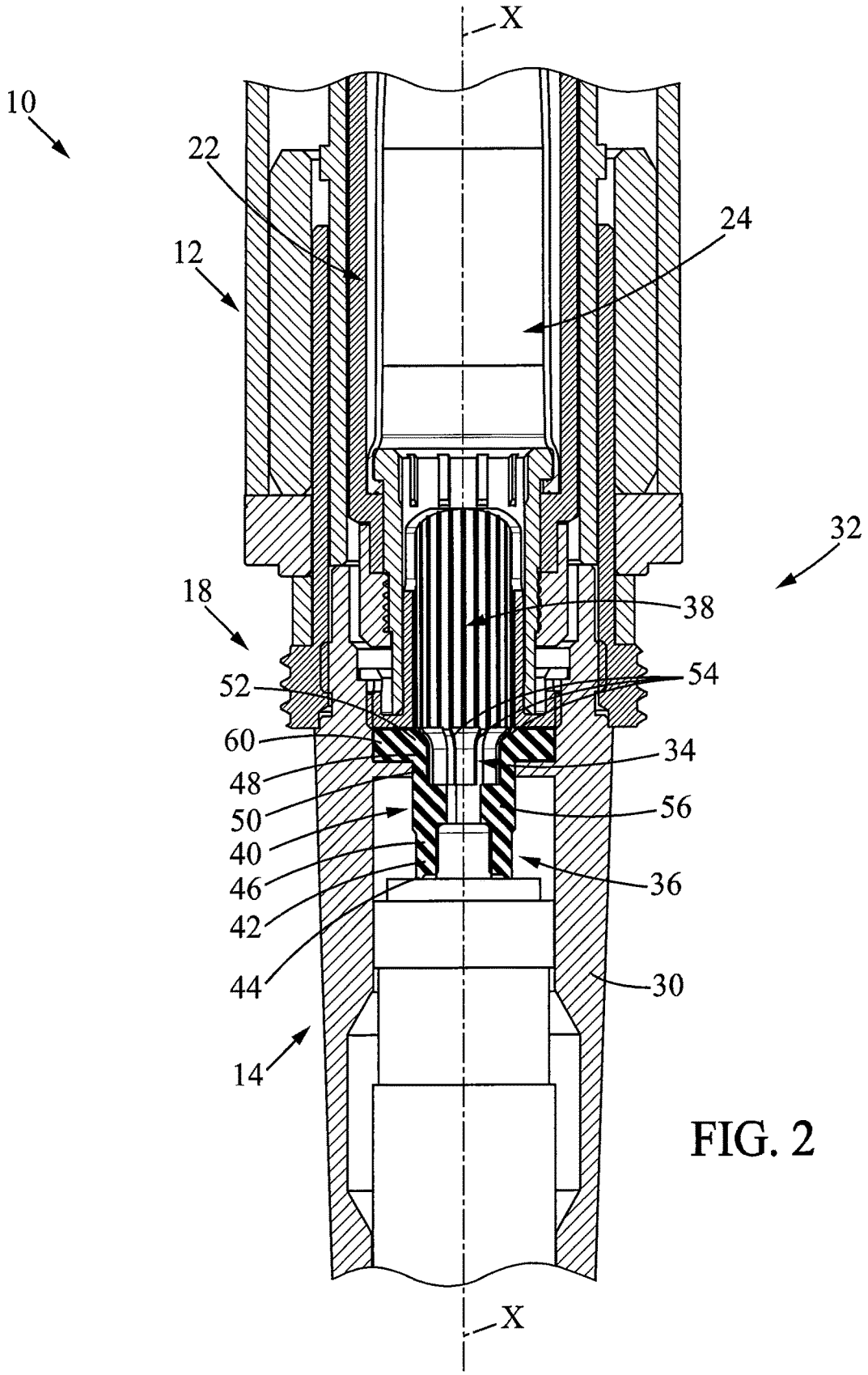
FIG. 2 is an enlarged view of the detail denoted II in FIG. 1.
Figure 3:
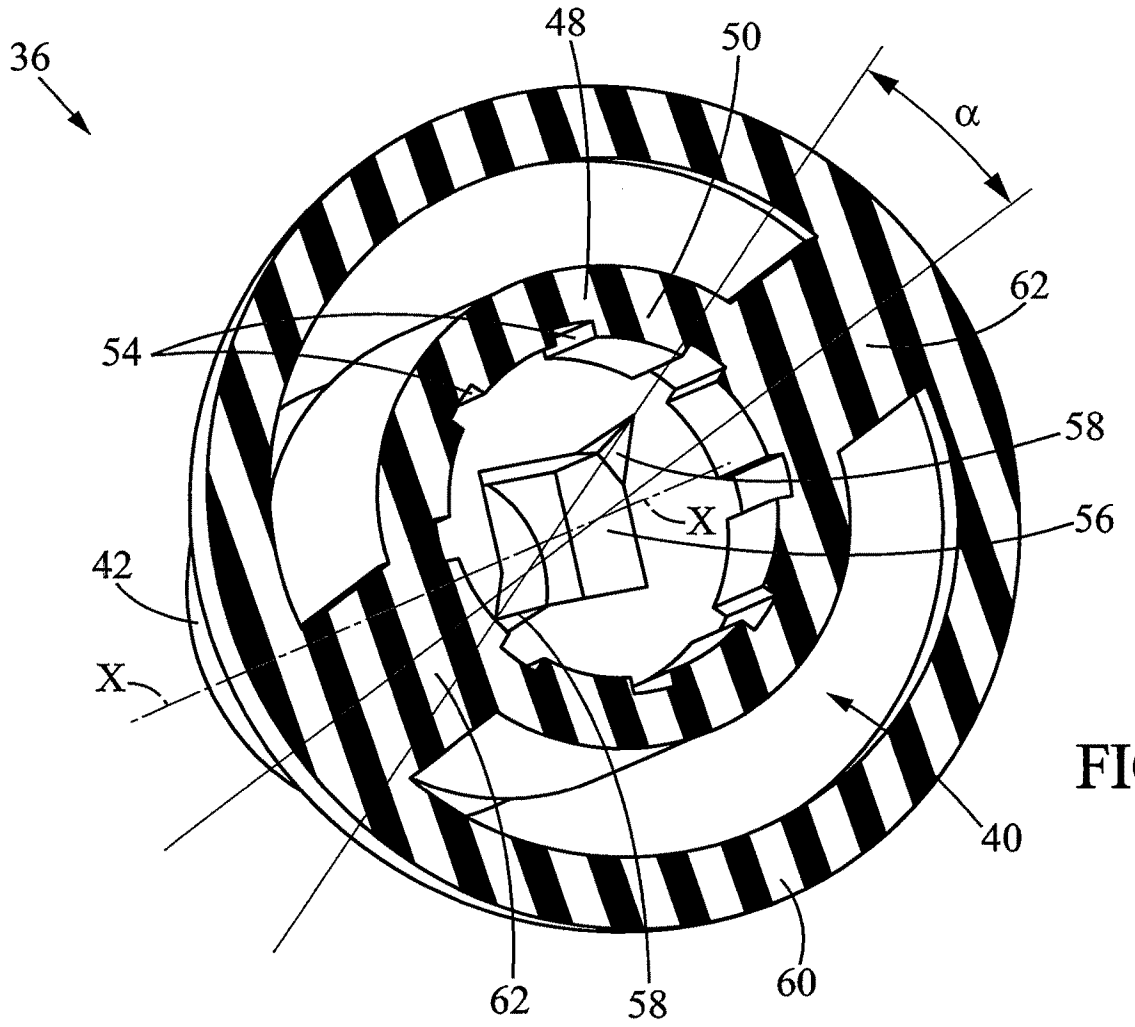
FIG. 3 is a partially cutaway perspective view of a valve of the fountain pen in FIG. 1.

As can best be seen in FIGS. 2 and 3, the valve 36 comprises a tubular member 40 extending along the longitudinal axis XX and defining a portion of the ink flow passage 34.

The tubular member 40 comprises a first end section 42 adapted to receive in a leak-tight manner the corresponding end of the nib 26/feeder 28 assembly.

The first end section 42 comprises a first portion 44 having a substantially circular internal cross-section, and a second portion 46 adjacent to the first portion 44.

The second portion 46 has a substantially circular internal cross-section which is smaller than that of the first portion 44.

The valve 36 is thus suitable for nib units 14 having ends of different dimensions.

The tubular member 40 comprises a second end section 48 opposite the first end section 42 and designed to cooperate with the striker 38.

The second end section 48 comprises a first portion 50 having a substantially circular and constant internal cross-section and a second portion 52 adjacent to the first portion 50.

The second portion 52 has a substantially circular internal cross-section which widens from the first portion 50 towards the striker 38.

The valve 36 comprises a plurality of longitudinal grooves 54 created on the inside surface of the second end section 48.

The tubular member 40 comprises a central section 56 connecting the first and second end sections 42, 48.

The central section 56 has a substantially square internal cross-section, each side substantially between 1 mm and 1.50 mm, preferably substantially equal to 1.35 mm.

This square shape optimizes the flow of ink through the valve 36.

The valve 36 comprises a pair of opposing cuts 58 (FIG. 3) that are substantially pyramidal in shape, made on two opposing vertices of the square internal cross-section of the central section 56, where it joins the second end section 48.

These cuts 58 facilitate the passage of ink from the ink reservoir 24 to the nib unit 14.

The valve 36 further comprises a collar 60 surrounding the second portion 52 of the second end section 48 and adapted to engage with the striker 38 to form a leak-tight seal.

The valve 36 comprises two opposing indexing lugs 62 extending radially between the first portion 50 of the second end section 48 and the collar 60.

The indexing lugs 62 are angularly offset about the longitudinal axis XX relative to the cuts 58, and therefore relative to a diagonal of the square internal cross-section of the central section 56, by an offset angle $\alpha$ (alpha).

The offset angle $\alpha$ is substantially equal to 20°.

The indexing lugs 62 allow optimally positioning the square internal cross-section of the central section 56 relative to the actuating pins of the valve 36 as explained below.

The valve 36 is adapted to selectively open and close the ink flow passage 34 by elastic deformation of the central section 56.

More specifically, the central section 56 of the valve 36 is resiliently deformable between a rest position (FIG. 4) wherein the ink flow passage 34 is open, and a deformed position (FIG. 5) where the ink flow passage 34 is closed.

In particular, in the rest position, the inner surfaces of the square internal cross-section of the central section 56 are spaced apart from each other.

In the deformed position, the opposing inner surfaces of the internal square cross-section of the central section 56 are in contact with each other.

The valve 36 is, for example, made from silicone, the silicone able to receive surface treatments and/or physical treatments allowing better ink flow.

Figure 4:
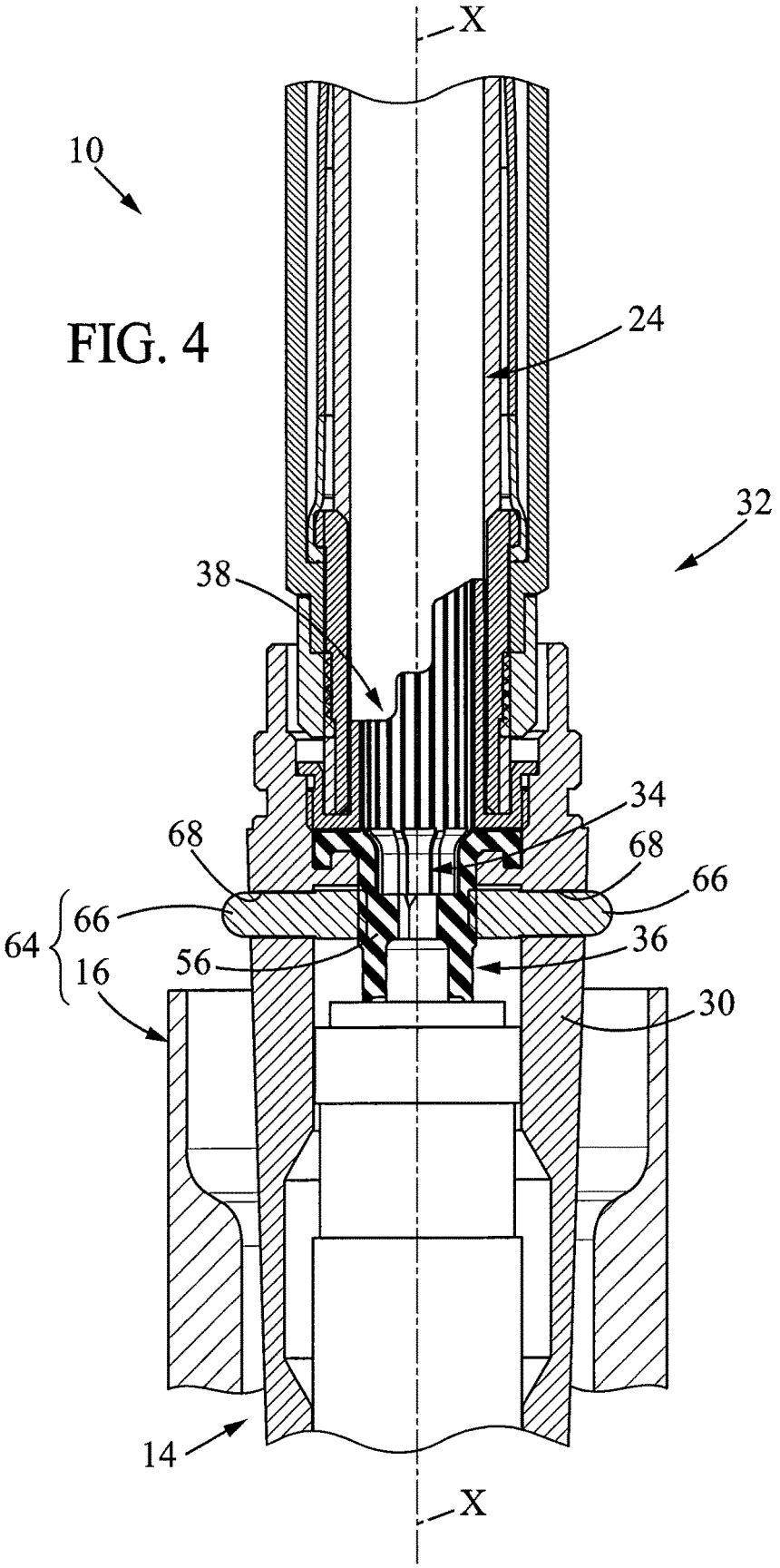
FIG. 4 is a similar view to that of FIG. 2 in a sectional plane offset angularly by 90° with respect to the plane of FIG. 2, the valve being in a rest position.
Figure 5:
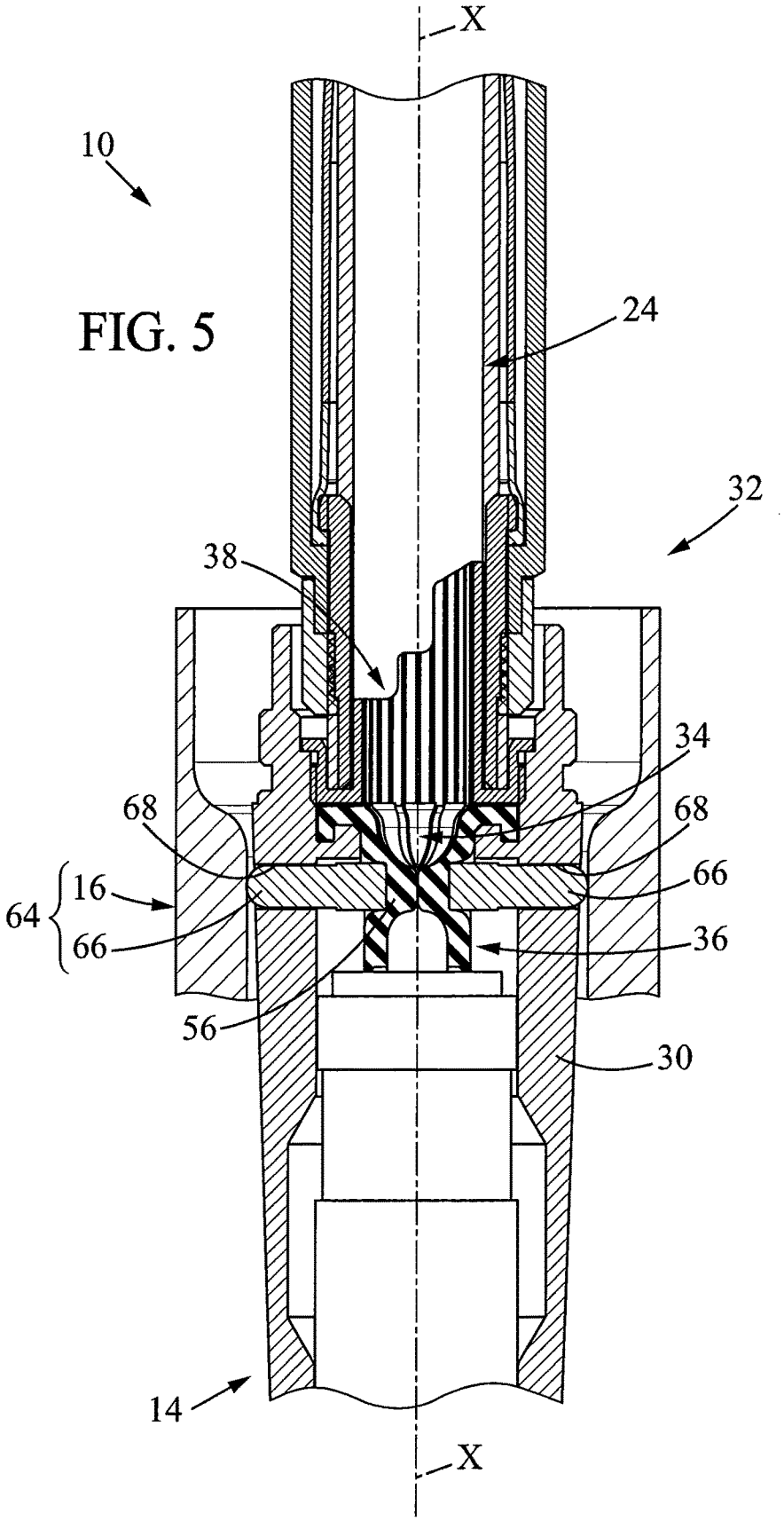
FIG. 5 is a view similar to that of FIG. 4, the valve being in a deformed position.

Referring to FIGS. 4 and 5, the fountain pen 10 comprises an actuator 64 for the valve 36, suitable for deforming the central section 56 of the valve 36.

The actuator 64 comprises the cap 16 and a pair of opposing pins 66 provided on the nib unit 14.

The pins 66 are placed in corresponding opposing radial holes 68 formed in the barrel 30 of the nib unit 14.

The pins 66 are angularly offset about the longitudinal axis XX relative to the indexing lugs 62 of the valve 36, by an angle substantially equal to 90°.

Thus, the pins 66 are angularly offset about the longitudinal axis XX relative to the cuts 58 in the valve 36, and therefore relative to a diagonal of the square internal cross-section of the central section 56 of the valve 36.

This offset angle corresponds to offset angle $\alpha$ (alpha).

The pins 66 are mounted relative to the barrel 30 so as to be slidable in a direction perpendicular to the longitudinal axis XX, between an initial position and an active position where force is exerted on the central section 56 which deforms it and closes the ink flow passage 34.

In the initial position of the pins 66 as shown in FIG. 4, the pins 66 have an end facing the central section 56 and an opposite end projecting radially from the barrel 30.

In this initial position, the central portion 56 is in its rest position and not deformed.

To move the pins 66 towards the active position, the cap 16 is threaded onto the barrel 30 along the longitudinal axis XX, the inner surface of the cap 16 then forcing the pins 66 towards one another.

In the active position of the pins 66 represented in FIG. 5, the pins 66 exert force on the central section 56 so that the central section 56 adopts its deformed position where the ink flow passage 34 is closed.

An offset angle that is substantially equal to 20° between the pins 66 and a diagonal of the square internal cross-section of the central section 56 of the valve 36 ensures that the ink flow passage 34 is indeed closed.

The central section 56 and the pins 66 are held in their distorted and active positions as long the cap 16 is clipped or screwed onto the hollow body 12.

Conversely, when the cap 16 is disengaged from the hollow body 12 and removed from the barrel 30 along the longitudinal axis XX, the central section 56 resumes its initial shape and simultaneously pushes the pins 66 outward, which opens up the ink flow passage 34.

The fountain pen 10 is then ready for use.

Figure 6:
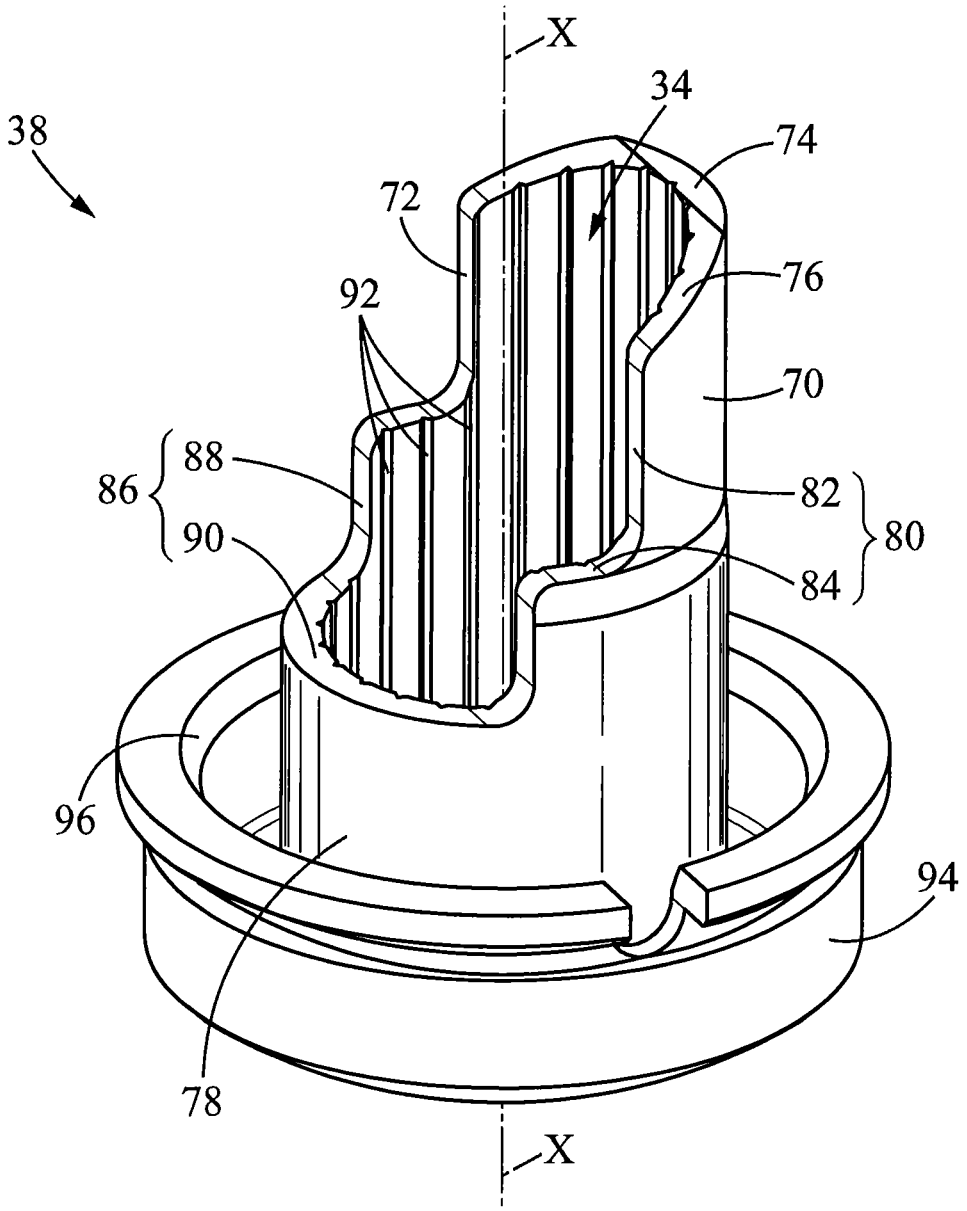
FIG. 6 is a perspective view of a striker of the fountain pen of FIG. 1.

FIG. 6 shows in detail the striker 38 of the connection part 32.

The striker 38 is adapted to cooperate with the ink reservoir 24 and allow ink to flow between the ink reservoir 24 and the nib 26/feeder 28 assembly.

The striker 38 comprises a substantially cylindrical tongue 70 extending substantially along the longitudinal axis XX and defining a portion of the ink flow passage 34.

The tongue 70 has a stepped contour with two shoulders, or in other words a profile resembling stairs, which increases the supply of ink closer to the valve 36.

More specifically, the tongue 70 comprises an end edge 72 having a flat portion 74 extending in a plane substantially perpendicular to the longitudinal axis XX.

The end edge 72 comprises, on each side of the flat portion 74, a first portion 76 that is inclined, relative to the longitudinal axis XX, towards the opposite end 78 of the tongue 70.

The end edge 72 comprises a first step or shoulder 80 formed by a second portion 82 substantially parallel to the longitudinal axis XX and extending the first portion 76 toward the opposite end 78, and by a third portion 84 substantially perpendicular to the second portion 82.

The end edge 72 comprises a second step or shoulder 86 formed by a fourth portion 88 substantially parallel to the longitudinal axis XX and extending the third portion 84 toward the opposite end 78, and by a fifth portion 90 substantially perpendicular to the fourth portion 88.

The tongue 70 comprises a plurality of longitudinal grooves 92 created on its inner surface.

The grooves 92 facilitate the flow of ink through the ink flow passage 34.

The tongue 70 comprises, for example, 24 grooves 92 regularly distributed about the longitudinal axis XX on the inner surface of the tongue 70.

The striker 38 further comprises a peripheral wall 94 surrounding the opposite end 78 of the tongue 70 and at a distance from the opposite end 78.

The space between the opposite end 78 and the peripheral wall 94 is adapted to receive the ink reservoir 24 in a leak-tight manner.

The peripheral wall 94 has a chamfer 96 formed on the free end of its inner surface which facilitates mounting the ink reservoir 24 on the striker 38.

The opposite end 78 of the tongue 72 and the peripheral wall 94 are placed in sealing contact with the second portion 52 of the second end section 48 of the valve 36 and with the collar 60.

The striker 38 is attached to the barrel 30 of the nib unit 14, for example by screwing, so that it slightly compresses the valve 36 and thus forms a seal with the valve 36 without deforming it.

The striker 38 is designed to work with different types of ink reservoir 24.

A converter 24A forming the ink reservoir is illustrated in FIG. 1.

The converter 24A comprises a mouth 100 received in a fluidtight manner on the striker 38, in the space between the tongue 70 and the peripheral wall 94.

The converter 24A comprises a flexible pouch 102 extending substantially along the longitudinal axis XX and in fluid communication with the ink flow passage 34.

The flexible pouch 102 is deformable and is made for example from silicone.

The flexible pouch 102 has a volume of between 0.8 and 0.9 mL, preferably substantially equal to 0.85 mL.

The converter 24A further comprises a piston 104 mounted to allow it to slide along the longitudinal axis XX in order to deform the flexible pouch 102, and a piston actuator 106 mounted to allow it to rotate about the longitudinal axis XX in order to move the piston 104.

The striker 38 is also designed to work with a cartridge forming the ink reservoir.

Such a cartridge comprises a rigid tube, a mouth arranged at one end of the tube, and a tube sealing plug inserted inside the mouth.

The mouth is adapted to be received in a fluidtight manner on the striker 38, in the space between the tongue 70 and the peripheral wall 94.

Thus, the mouth has an inside diameter that is greater than the outside diameter of the tongue 70 of the striker 38.

For example, the inside diameter is between 6.8 mm and 7.3 mm, preferably substantially equal to 7.1 mm.

The tube sealing plug is forcibly inserted inside the mouth, substantially at the center of the mouth, and extends substantially perpendicularly to the longitudinal axis XX before the cartridge is mounted on the striker 38.

When the cartridge is mounted on the striker 38, the stepped contour of the tongue 70 tilts the plug and pushes it back into the tube, where the plug is then lying substantially along the longitudinal axis XX and resting on the first shoulder 80 of the tongue 70.

The inner surface of the tube may comprise longitudinal grooves for more efficiently draining the ink towards the mouth.

With these arrangements, a significant flow of ink can be supplied to the nib unit 14.

The invention therefore provides a fountain pen that is sealed in the closed position regardless of the conditions to which it is subjected, including variations in temperature and/or pressure, which ensures optimum ink circulation from the ink reservoir to the nib.

Indeed, the characteristics of the valve and striker as well as their relative arrangement not only reduce the leakage of ink when the cap is opened but also improve the flow of ink within the fountain pen.

Furthermore, a fountain pen of the invention that has this "universal" striker can be used with various types of removable ink reservoirs, whether converters or cartridges.

The invention claimed is:

1. A fountain pen comprising:

an elongate hollow body defining an inner chamber adapted to receive an ink reservoir;

a nib arranged at a first end of the hollow body; and a connection part connecting the inner chamber and the nib and defining an ink flow passage extending along a longitudinal axis, the connection part comprising a valve for opening and closing the ink flow passage, designed to selectively open and close the ink flow passage, wherein the connection part comprises a striker interposed between the valve and the inner chamber and designed to engage with the ink reservoir and allow ink to flow between the ink reservoir and the nib, wherein the striker comprises a substantially cylindrical tongue extending along said longitudinal axis and defining a portion of the ink flow passage, said tongue comprising an end edge and an opposite end, said striker comprising a peripheral wall surrounding said opposite end and at a distance from the opposite end defining a space between the opposite end and the peripheral wall, wherein said space between the opposite end and the peripheral wall is adapted to receive the ink reservoir in a leak-tight manner.

2. The fountain pen according to claim 1, wherein the valve comprises a tubular member defining a portion of the ink flow passage and comprising a central section that is elastically deformable between a rest position where the ink flow passage is open, and a deformed position where the ink flow passage is closed.

3. The fountain pen according, to claim 2, comprising a barrel that supports said nib and a pair of opposing pins mounted on the barrel, the pins being adapted to deform the central section.

4. The fountain pen according to claim 3, wherein the pins are mounted so as to slide relative to the barrel in a direction perpendicular to the longitudinal axis.

5. The fountain pen according to claim 3, comprising a protective cap for the nib, designed to be mounted onto the barrel along the longitudinal axis and to displace the pins when it is mounted onto the barrel.

6. The fountain pen according to claim 2, wherein the central section has a substantially square-shaped internal cross-section.

7. A fountain pen comprising:

an elongate hollow body defining an inner chamber adapted to receive an ink reservoir;

a nib arranged at a first end of the hollow body; and a connection part connecting the inner chamber and the nib and defining an ink flow passage extending along a longitudinal axis, the connection part comprising a valve for opening and closing the ink flow passage, designed to selectively open and close the ink flow passage, wherein the connection part comprises a striker interposed between the valve and the inner chamber and designed to engage with the ink reservoir and allow ink to flow between the ink reservoir and the nib, wherein the valve comprises a tubular member defining a portion of the ink flow passage and comprising a central section that is elastically deformable between a rest position where the ink flow passage is open and a deformed position where the ink flow passage is closed, the fountain pen comprising a barrel that supports said nib and a pair of opposing pins mounted on the barrel, the pins being adapted to deform the central section, wherein the central section has a substantially square-shaped internal cross-section, and wherein the pins are offset angularly, about the longitudinal axis, relative to a diagonal of the square internal cross-section of the central section.

8. The fountain pen according to claim 7, wherein the offset angle is substantially equal to 20° C.

9. The fountain pen according to claim 2, wherein the tubular member comprises an end section arranged between the central section and the striker and defining a portion of the ink flow passage, the end section comprising an inner surface and a plurality of longitudinal grooves created on the inner surface.

10. A fountain pen comprising:

an elongate hollow body defining an inner chamber adapted to receive an ink reservoir;

a nib arranged at a first end of the hollow body; and a connection part connecting the inner chamber and the nib and defining an ink flow passage extending along a longitudinal axis, the connection part comprising a valve for opening and closing the ink flow passage, designed to selectively open and close the ink flow passage, wherein the valve comprises a tubular member defining, a portion of the ink flow passage and comprising a central section that is elastically deformable between a rest position where the ink flow passage is open, and a deformed position where the ink flow passage is closed, wherein the connection part comprises a striker interposed between the valve and the inner chamber and designed to engage with the ink reservoir and allow ink to flow between the ink reservoir and the nib, wherein the central section has a substantially square-shaped internal cross-section, and wherein the tubular member comprises an end section arranged between the central section and the striker and defining a portion of the ink flow passage, the end section comprising an inner surface and a plurality of longitudinal grooves created on the inner surface, and wherein the tubular member comprises a pair of opposing cuts made in the square internal cross-section of the central section where it connects to the end section.

11. The fountain pen according to claim 1, wherein the striker comprises a substantially cylindrical tongue delimiting a portion of the ink flow passage and having a stepped contour with two steps.

12. The fountain pen according to claim 11, wherein the tongue comprises an inner surface and a plurality of longitudinal grooves created on the inner surface.

13. The fountain pen according to claim 1, further comprising a converter forming the ink reservoir and mounted on the striker.

14. The fountain pen according to claim 1, further comprising a cartridge forming the ink reservoir and mounted on the striker, the cartridge comprising a rigid tube, a mouth arranged at one end of the tube, and a tube sealing plug inserted into the mouth.

15. The fountain pen according to claim 11, further comprising a cartridge forming the ink reservoir and mounted on the striker, the cartridge comprising a rigid tube, a mouth arranged at one end of the tube, and a tube sealing plug inserted into the mouth, and wherein the mouth has an inside diameter that is greater than the outside diameter of the tongue of the striker.

16. The fountain pain according to claim 11, wherein the converter comprises a flexible pouch extending along a longitudinal axis and intended to be in fluid communication with the nib by means of the connection part, and a piston mounted so as to slide along the longitudinal axis and intended to deform the flexible pouch.

* * * * *